M7219 XR 4,281,713

United States Patent [19]

Wood et al.

[11] 4,281,713

[45] Aug. 4, 1981

[54] METHOD AND APPARATUS FOR MONITORING THE POSITION AND MOVEMENT PROGRESS OF THE FLAME FRONT IN AN UNDERGROUND COMBUSTION

[75] Inventors: Milton D. Wood, Portola Valley, Calif.; Daniel Silverman, Tulsa, Okla.

[73] Assignee: M. D. Wood, Inc., Palo Alto, Calif.

[21] Appl. No.: 56,064

[22] Filed: Jul. 9, 1979

[51] Int. Cl.[3] ..... E21B 43/243; E21B 47/00

[52] U.S. Cl. ..... 166/251; 166/52; 166/64; 166/65 R

[58] Field of Search ..... 166/251, 256, 52, 64, 166/66, 113, 65 R

[56] References Cited

U.S. PATENT DOCUMENTS

| | | | |
|---|---|---|---|
| 2,770,305 | 11/1956 | Pirson | 166/251 |
| 2,803,305 | 8/1957 | Behning et al. | 166/251 |
| 3,072,184 | 1/1963 | Parker | 166/251 |
| 3,483,730 | 12/1969 | Gilchrist et al. | 166/251 X |
| 4,082,145 | 4/1978 | Elkington | 166/251 |
| 4,143,714 | 3/1979 | Agnew | 166/252 |

*Primary Examiner*—Stephen J. Novosad
*Attorney, Agent, or Firm*—Daniel Silverman

[57] ABSTRACT

An underground combustion operation in which combustible material, in a selected geologic formation at a selected depth, is burned by forcing air under pressure down a first well into the formation, and collecting products of combustion at a second well, a selected distance away from the first well. The overburden above the formation is supported, in part, by the combustible material, which might be viscous oil, tar, etc. This material is ignited at the first well and a flame front is formed which burns in the form of a circular front, which moves radially outwardly as a function of time and the rate of air supply. A plurality of electronic tilt meters are positioned at or near the surface of the earth, in at least one linear array directed along the radius from the first well to the second well. Combustion air is provided and the outputs of the tilt meters are amplified and recorded as a function of time. As the flame front progresses, the overburden behind the front will slump, which will be selected by a corresponding slump and tilting of the earth surface, which will be reflected in the corresponding readings of the tilt meters.

15 Claims, 5 Drawing Figures

METHOD AND APPARATUS FOR MONITORING THE POSITION AND MOVEMENT PROGRESS OF THE FLAME FRONT IN AN UNDERGROUND COMBUSTION

BACKGROUND OF THE INVENTION

1. Field of the Invention

This invention lies in the field of geophysical measurements on the earth's surface for determining subsurface physical conditions in the earth.

This invention is more particularly concerned with making physical measurements at the surface of the earth for determining the position and movement of a flame front within a subsurface formation at a selected depth under the surface, the progress of the flame front being caused by continued supply of air through at least one central well.

This invention is still more particularly concerned with detection of the presence and passage of a flame front within a geologic formation under the surface of the earth, where the overburden rock is supported in part by a combustible hydrocarbon material. As the flame front progresses and moves past a selected point, the overburden will slump, thinning the formation, and causing a slight lowering of the earth's surface over the slumped portion, which will cause a slight tilting of the earth's surface, which is detectable by tilt meters.

2. Description of the Prior Art

In the prior art, experiments have been carried on for many years by oil companies and others, in which coal, tar sands, oil shales, and other combustible hydrocarbon materials have been burned, in situ, within their natural formations, at selected shallow depths in the earth. Many experiments have been carried out, using thermal, gravity, magnetic, and other measurements, to indicate the position of the flame front at any time, but without success.

Knowledge of the position of the flame front is very important in the management of the operation since it is desired that the flame front be moved outwardly in a selected manner so as to completely burn all the material within a selected area. Lack of knowledge may make it impossible to burn all the material and, therefore, the operation would be less efficient than it might be.

To date, there has not been any satisfactory method for monitoring the position and the progress of a flame front in an underground burning operation in a geologic formation.

SUMMARY OF THE INVENTION

It is a primary object of this invention to provide a method and apparatus for detecting the passage of a flame front in an underground burning operation in relation to a line of detectors on the surface of the earth.

These and other objects are realized and the limitations of the prior art are overcome in this invention, by providing a burning operation in which at least a first well and a second well are drilled from the surface down to a depth D, to a geological formation F, in which there is combustible material in a matrix, such that the overburden rock is supported by the matrix. If the combustible material is removed by burning, the mechanical support for the overburden will be reduced, and the overburden will slump. Means are provided for supplying compressed air to the first or input well, and for igniting the combustible material in formation F, at the first well.

Means are provided at the second or output well for collecting gaseous and liquid products of the burning operation. They are brought to the surface and utilized in any selected manner. It is well-known that, as air is pumped into the input well, the flame will be maintained and the rock will be heated to the point where the combustible material will ignite continuously so long as additional air is provided. Thus, depending upon the total integrated volume of air pumped into the first well, the flame front will have advanced outwardly, in a more-or-less circular configuration, and will progress outwardly, dependent upon the configuration of the formation, and the porosity and permeability, etc. of the formation.

In this method of detecting the presence and passage of a flame front, use is made of the phenomenon that, as the formation is burned, the volume of material within the formation will be reduced by the volume of material burned. Some of the hydrocarbons will be converted to gaseous products which will move forward ahead of the flame front. Other products, such as liquid hydrocarbons, will be forced radially outwardly by the pressure of the air supply, so that the overburden will then be less supported, and will slump, and come to rest on the remaining non-combustible materials, such as sand, or shale particles, etc.

As the overburden slumps in the formation, there will be a consequent, and similar, slumping at the surface of the earth. Although this surface slumping may be quite small, it will be detectable by the sensitive tilt meters which are available on the market.

The process of instrumentating and observing the combustion operation involves positioning in shallow bore holes, at or near the surface of the earth, a plurality of sensitive tilt meters, which are spaced apart in at least one linear array, aligned with the radius between the first well and the second well. Preferably, in a complete survey of the underground operations, with a single well input, the operation will involve a plurality of radial arrays of tilt meters, all centered at the air input well. The arrays would be preferably, equiangularly-spaced around the first well so as to better detect the progress of an assumed circular burning front.

Generally, the tilt meters are designed with two orthogonal directions of sensitivity and these instruments should preferably be positioned so that one of these directions is colinear with the line of array, so that maximum sensitivity of tilt is available in the direction of the radius between the first and second wells.

If the burning operation takes place between a line of spaced input wells and a corresponding line of spaced output wells, parallel to the line of input wells, then the linear arrays of tilt meters would preferably be aligned perpendicular to the arrays of input and output wells. Of course, other configurations of wells and corresponding configuration of tilt meters can be designed for selected burning conditions.

Once the flame has been initiated and the flame front is progressing due to the continued supply of air under pressure, the outputs of each of the tilt meters are amplified and recorded as a function of time. Preferably, also, the air supply flow rate is measured and recorded continuously as a function of time. The integrated air flow is correspondingly calculated and recorded. Thus, the progress of the flame front can be determined as a function of the total supply of combustion air.

While the method can be utilized with any suitable tilt meter, it is preferred to use a tilt meter which is manufactured by the Rockwell Instrument Company of Anaheim, California.

BRIEF DESCRIPTION OF THE DRAWINGS

These and other objects and advantages of this invention, and a better understanding of the principles and details of the invention, will be evident from the following description taken in conjunction with the appended drawings, in which.

DESCRIPTION OF THE PREFERRED EMBODIMENT

Figure 2:
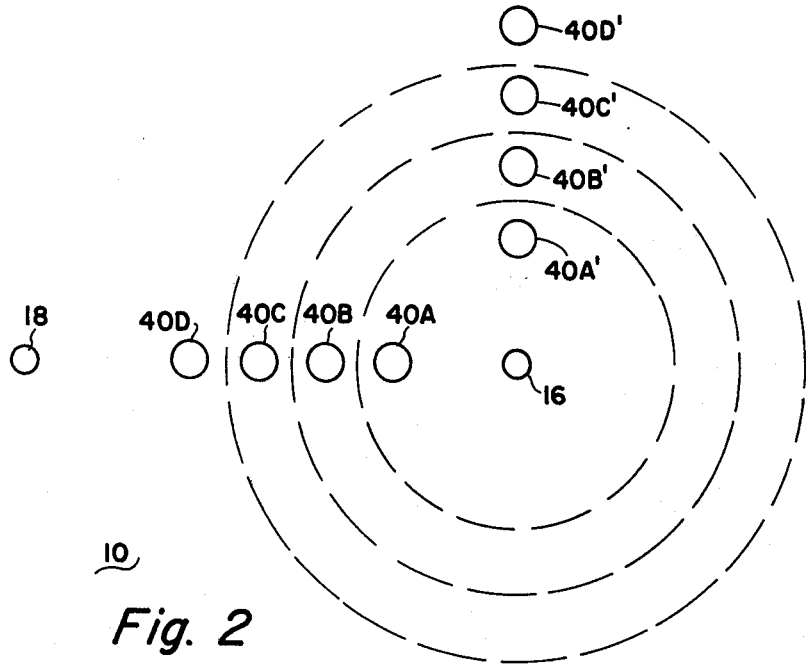
FIGS. 1 and 2 represent in a vertical cross-section through the earth and in plan view, respectively, one embodiment of this invention.
Figure 1:
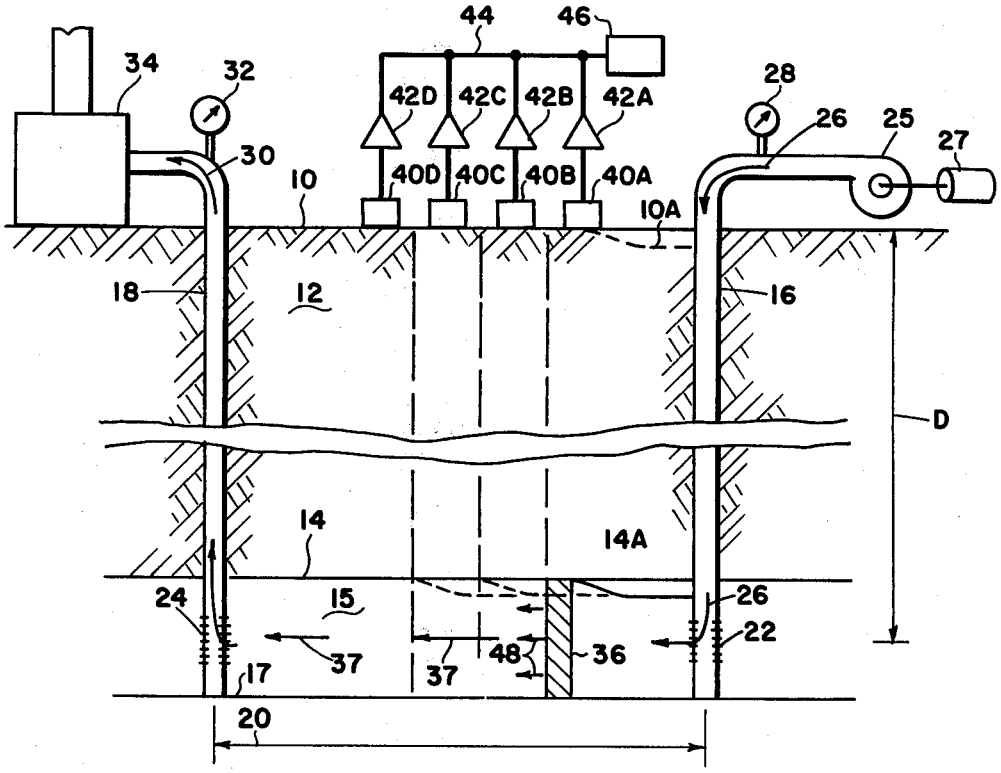

Referring now to the drawings and, in particular, to FIGS. 1 and 2, there is shown a cross-section of the earth 12 with the surface represented by 10. A first well 16 is drilled from the surface down to a depth D to a formation 15 having an upper interface 14 and a lower interface 17. A second, or output well 18, is drilled from the surface down to the formation 15 and means are provided for bringing to the surface through the casing of the well 18, liquids and gases which are by-products of the combustion operation. Means 32 are provided for measuring the pressure within the cased well 18. Apparatus 34 is provided for separating, purifying, or chemically processing the liquid or gaseous products 30, which are brought to the surface, as is well-known in the art.

At the first well 16, power means 27 drives a blower 25 to provide combustion air flow in accordance with arrow 26 at a pressure indicated by a meter 28 to the casing of the well 16, down to perforations 22 at the level of the formation 15.

By well-known methods which have been developed over the last 10 to 15 years, or so, means have been developed for igniting the combustible material in the formation 15 at the well perforations 22, so that a combustion zone (indicated by shading 36) in the form of an annular ring around the well 16 is provided. Here the incoming air 26 serves to maintain the combustion in the front 36, which, as additional air is brought in, forces the flame radially outwardly in accordance with arrows 38. As the flame front moves along, the remaining non-combustible material, or rock elements, such as sand, shale, and bits of rock, etc., remain behind.

The total volume of the non-combustible material is considerably less than the original formation material, which included bits of rock plus the combustible material. Thus, as the burned rock cools and compacts, the overlying rock will settle and slump, and the interface 14 will assume a new tilted and lowered interface 14A, as shown in FIG. 1. The amount of slump will, of course, depend on the conditions in the particular burning operation, namely, the thickness of the formation 16, the amount of combustible material present, etc. However, there should be considerable reduction in volume of solid, or semi-solid, material and, thus, there will be some slumping in the manner of surface 14A.

The progress of the flame front is a long-duration phenomenon, taking many weeks or months to progress any considerable distance radially outwardly. However, when the flame front has progressed a sufficient distance, there is no question but what there will be slumping, and that slumping, indicated by 14A, will eventually be reflected by a corresponding slumping 10A at the surface, indicated in FIG. 1.

Figure 3:
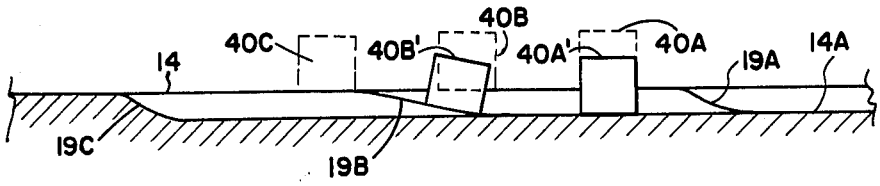
FIG. 3 illustrates in cross-section the near surface of the earth and the progress of a flame front as indicated by a tilt meter.
Figure 4:
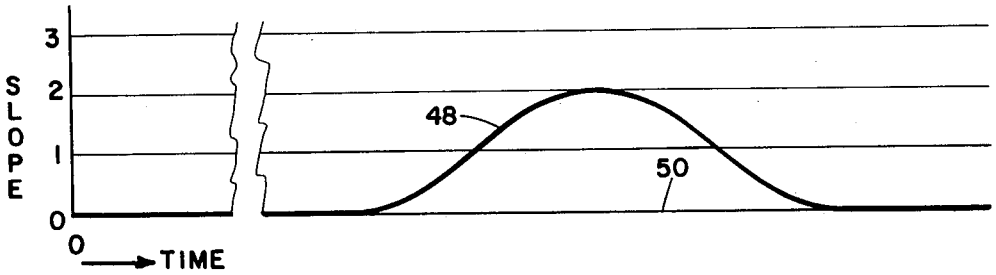
FIG. 4 illustrates the response of an individual tilt meter to the progress of the flame front.

Refer for a moment to FIGS. 3 and 4. FIG. 3 is an enlarged portion of the surface 14 and 14A of the FIG. 1 and the tilt meters are indicated by cubes 40A, 40B, 40C, etc., spaced along a line from right to left. Consider the presence of three tilt meters 40A, 40B, and 40C, which rest on the surface 14. Consider that a slump takes place in accordance with the surface 14A, which is substantially horizontal at one point and curves upwardly and tangentially approaches the surface 14 along the curve 19A. So far as the first tilt meter 40A is concerned, the slump 19A has not yet had an effect on the first tilt meter. When the slump front 19A approaches the position 19B, tilt meter 40B is now resting at an angle on the slope portion 19B. Tilt meter 40A, which previously had been tilted, similar to 40B, is now again horizontal, since the sloping part of the slump 19B has passed 40A. Tilt meter 40C is still not affected by the flame front since the sloping part 19B has not reached as far as the tilt meter 40C.

In FIG. 4 is shown a curve 48, which represents the angle of tilt of the surface on which the tilt meter 40 is resting, as a function of time. Time starts at the left, and moves to the right. The tilt changes very slowly to a maximum, and then reduces to zero. The progress of the flame front will be quite slow, particularly when its radius becomes very large, since there is a tremendous volume of material to be burned and the rate of burning is determined by the rate of flow of combustion air. It will be clear that since the slumping of the overburden starts at the well 16, the tilting of the surface will be down (19A, 19B, FIG. 3) in the direction toward the well 16, as clearly shown in FIGS. 1 and 3. It will be clear also that after the passage of the slump from position 19A past 40A, to 19B, the tilt of the earth's surface will return to zero 14A.

The entire recording process must be carried on, more or less, continuously for many weeks or months. This provides an opportunity for monitoring the sensitivity and stability of operation of the tilt meters since there will be other tilts of the earth's surface due, for example, to gravity waves resulting from the movement of the sun, and moon across the surface of the earth, and from other causes. Such a continuous day-by-day repetition of the diurnal effect is useful in calibrating the meters and in observing the other effects not directly related to combustion, which will continue to have their effect on the instrumentation readings when the burning process reaches the position of the tilt meters. This early and late (before and after) recording of the tilt meters can then be used to correct the observed readings of the tilt meters when the burning front is in their vicinity.

For example, over a long period of time, if it is determined that the response of the tilt meter is to gravity effects of the tides and the moon, and sun, etc., such values of tilt can be fully evaluated prior to and after the flame front has passed an individual tilt meter. Therefore, those values can be subtracted from the overall measurements during the time that the flame front is in the vicinity of that particular tilt meter.

Referring now to FIG. 2, there is shown a plan view of the surface of the earth with the wells 16 and 18 and two arrays 40 and 40' of tilt meters, arranged in radial linear arrays, centered on the input well 16.

In a prolonged burning operation it may be desirable to have a large number of such arrays as 40 and 40', as many, for example, as 8, each of them 45° angularly displaced from the others.

Another manner in which the arrays of tilt meters can be carried out with a minimum cost of tilt meter units, would be to place the tilt meters in closely spaced array at short radii from the input well 16. Then, as the progress of the burning front is increased, such that the burning front is now past the first or second tilt meter, they can be repositioned at greater radius than the fourth tilt meter, for example. Progressively, as the burning front moves outwardly, the tilt meters can be repositioned to be beyond the present value of the radius of the burning front, or flame front, etc.

Figure 5:
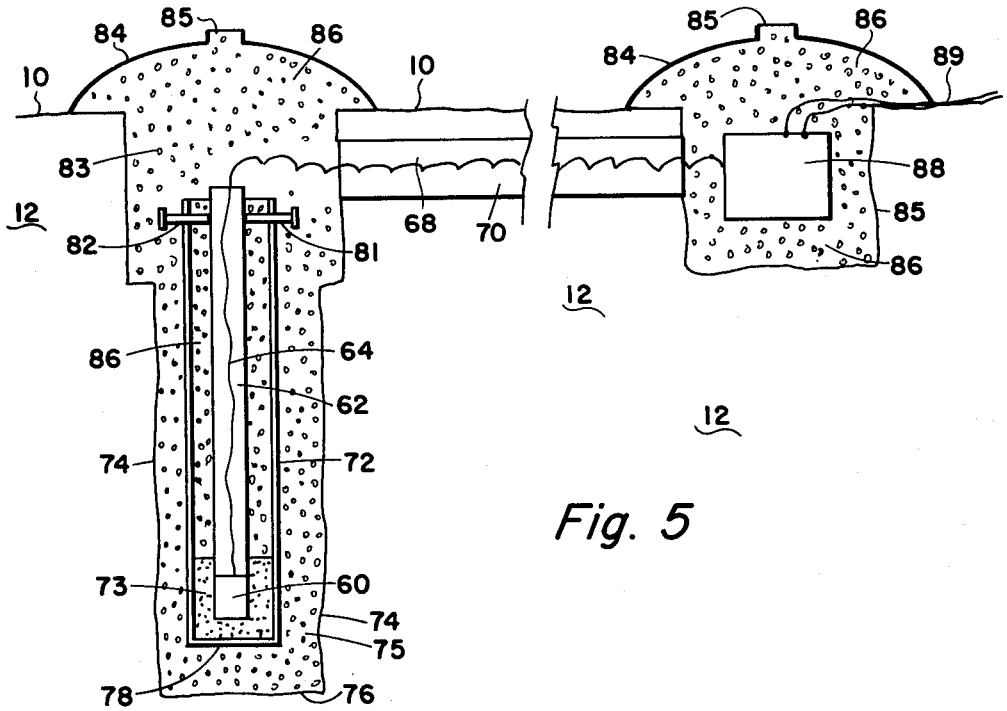
FIG. 5 illustrates in vertical cross-section one manner of planting or positioning a tilt meter for use in detecting the motion of a flame front underground.

Reference is now made to FIG. 5, which illustrates, in cross-section, a shallow portion of the earth illustrating the manner in which a tilt meter instrument, indicated by the shaded area 60 is planted or positioned in the earth.

A shallow bore hole drilled to a depth of the order of 6 feet, or so, is indicated by the wall 74. A casing 72, which is approximately 6 feet long, and closed at the bottom, is positioned inside of the borehole 74 with the bottom and sides filled with sand 75. The pipe casing 72 is prepared with 3, or preferably 4, long-threaded screws 81, 82, inserted into threaded openings in the wall of the casing near the top.

The tilt meter instrument 60 is conventional and manufactured by the Rockwell Instrument Co., of Anaheim, California.

It is attached to a tubular element 62, with the electrical conductors 64, which comprise power plus signal leads, being brought up through the center of the tubular element 62. A small quantity of sand 73 is inserted around the bottom of the instrument 60 inside the casing 72, which is held fast by the sand. The top end of the instrument is adjusted by means of the control screws 81 and 82, etc., so that the tubular support means 62 is aligned truly vertical and is securely held by the sand at the bottom of the casing, and by the alignment screws 81 and 82, etc., at the top.

The space inside of the casing is now filled with insulating particles of foamed plastic, etc., for purpose of thermal insulation. The space 83 in the borehole above the apparatus, is also filled with this material 86. A stream-lined circular canopy 84 is provided to cover the opening in the ground, so that the space inside is filled with this insulating material 86 through an opening 85, which can be closed by any desired means.

The electrical conductors 68 are carried out the top of the support means 62 through an insulating pipe 70, which is buried under the surface 10 of the earth 12 between the instrument hole 74 and a shallow hole 85, in which the electrical amplifiers and processing instrumentation 88 are positioned. Again, the space around the instrumentation 88 and above the surface of the earth under the streamlined canopy 84 is filled with the insulating material 86 through the opening 85. The leads 89, which connect to the amplifier and control instrumentation 88, go to a recorder, as is shown in FIG. 1.

No detail is necessary for describing the tilt meter, since this is a commercial device manufactured by the Rockwell Instrument Company in Anaheim, California. Any type tilt meter, which will resolve $10^{-7}$ to $10^{-8}$ radians will be suitable for this application, since the expected noise in the form of gravity waves, etc., are a factor of 10 smaller than this value.

While I have stated that the recording must be carried on continuously for many weeks or months, this does not necessarily mean continuously for 24 hours each day, since the recording could be intermittent for a selected interval of time each hour, or each day, and so on.

While the description of FIG. 5 is based upon a particular type of tilt meter, other types of tilt meters can, of course, be used in practising this invention, which would require a different method of placement.

While this invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element or step thereof is entitled.

What is claimed is:

1. In a system for monitoring the progress of the flame front in an underground combustion operation, wherein the combustion takes place in a selected subsurface geological formation F, in which the overburden above said formation F is supported in part by the combustible material within said formation F, the method of monitoring the position and progress of said flame front, comprising:

(a) providing at least a first well drilled to the depth of said formation F, in which said combustion is to be initiated;

(b) providing at least a second well, spaced from said first well, to said formation F, through which products of said combustion can be brought to the surface;

(c) providing a source of combustion air to said first well at a selected super atmospheric pressure;

(d) positioning a plurality of tilt meters, at or near the surface of the earth, in at least one selected spaced array, between said first and second wells;

(e) igniting said combustible material in said formation F, at said first well, to provide a flame front;

whereby, as said combustible material is burned, under the pressure of said combustion air, said flame will progress outwardly from said first to said second well; and a portion of the overburden will slump inside of the flame front;

(f) recording the output of said tilt meters as a function of time during the progress of said flame front past the position of at least one of said tilt meters; and (g) determining the angle of tilt of the surface of the earth in the direction of down toward said first well, in the vicinity of at least one of said tilt meters.

2. The method as in claim 1 including the step of recording the flow rate of combustion air supplied to said first well.

3. The method as in claim 1 in which said tilt meters are designed to indicate tilt in 2 orthogonal directions, and including the additional step of positioning said tilt meters by aligning one of said directions along the line front said first to said second well.

4. The method as in claim 1 of providing a plurality of radial arrays of tilt meters, said arrays centered at said first well.

5. The method as in claim 1 in which a continuing intermittent recording is made of the outputs of said tilt meters, wherein said outputs are recorded simultaneously for A units of time in each B units of time.

6. The method as in claim 1 in which said tilt meters indicate tilt in at least one direction, and including the additional step of positioning said tilt meters by aligning said at least one direction along the line toward said first well.

7. In a system for underground combustion of a combustible material in a selected subsurface geological formation F at a selected depth D below the surface, said system including a first input well drilled to a depth D to said formation F and adapted to receive air at a selected pressure P for combustion of said combustible material, and at least one second output well drilled to depth D to said formation F, through which products of said combustion can be brought to the surface;

apparatus for monitoring the outward progress of the flame front from said first well, comprising;

(a) a plurality of tilt meters to be positioned at or near the surface of the earth, arranged in at least one selected array between said first well and said second well;

(b) means to supply air under pressure to said input well, and to ignite said combustible material in said formation F at said first well;

whereby a flame front will be started, which will travel outwardly between said first well and said second well, and a portion of the overburden inside of said flame front will slump;

(c) means amplifying the output signals of said tilt meters to form amplified output signals;

(d) means for recording said amplified output signals as a function of time; and (e) means for determining the angle of tilt of the surface of the earth in the direction of down toward said first well.

8. The apparatus as in claim 7 in which said tilt meters indicate the tilt in two orthogonal directions, and including means to position said tilt meters such that one of said orthogonal directions lies in the line of said array.

9. The apparatus as in claim 7 in which said plurality of tilt meters are divided into at least two groups, each group positioned in a radial-spaced array, angularly spaced from each other.

10. The apparatus as in claim 7 in which each tilt meter is positioned in the earth in a positioning system comprising;

(a) a drilled shallow borehole in the earth;

(b) a support casing comprising a piece of pipe closed at the bottom, of selected length and diameter, positioned in said borehole, surrounded by tamped sand in the annulus between said pipe and the earth;

(c) a plurality of angularly-spaced radial positioning screws through said pipe near its top end;

(d) said tilt meter attached to a tubular support means and positioned vertically inside said pipe; sand poured around said tubular support means at its bottom end;

the upper end of said tubular support means locked by said positioning screws to hold said support means vertical.

(e) a streamlined cover means over said borehole at the surface; and (f) the space around said support means, and on top of said apparatus in said borehole, and under said streamlined cover means filled with thermal insulation means.

11. The apparatus as in claim 5 in which said tilt meters indicate the tilt in at least one direction, and including means to position said tilt meters such that said at least one direction lies in the line toward said first well.

12. In a system for monitoring the progress of the flame front in an underground combustion operation, wherein the combustion takes place in a selected subsurface geological formation F, in which the overburden above said formation F is supported in part by combustible material within said formation F, the method of monitoring the position and progress of said flame front, comprising;

(a) providing at least a first well drilled to the depth of said formation F, in which said combustion is to be initiated;

(b) providing at least a second well, spaced from said first well, to said formation F, through which products of said combustion can be brought to the surface;

(c) providing a source of combustion air to said first well at a selected super atmospheric pressure;

(d) positioning a plurality of tilt meters, at or near the surface of the earth, in at least one selected spaced array, between said first and second wells;

(e) igniting said combustible material in said formation F, at said first well, to provide a flame front;

whereby, as said combustible material is burned, under the pressure of said combustion air, said flame will progress outwardly from said first to said second well;

(f) recording the output of said tilt meters as a function of time during the progress of said flame front past the position of at least one of said tilt meters; and (g) said tilt meters are designed to indicate tilt in 2 orthogonal directions, and positioning said tilt meters by aligning one of said directions along the line to said first well.

13. In a system for underground combustion of a combustible material in a selected subsurface geological formation F at a selected depth D below the surface, said system including a first input well drilled to a depth D to said formation F and adapted to receive air at a selected pressure P for combustion of said combustible material, at least one second output well drilled to depth D to said formation F, through which products of said combustion can be brought to the surface;

apparatus for monitoring the outward progress of the flame front from said first well, comprising;

(a) a plurality of tilt meters to be positioned at or near the surface of the earth, arranged in at least one array between said first well and said second well;

(b) means to supply air under pressure to said input well, and to ignite said combustible material in said formation F at said first well;

whereby a flame front will be started, which will travel outwardly as a function of the integrated flow of air supplied to said first well;

(c) means for recording the output signals from said tilt meters as a function of time; and in which at least one of said tilt meters is positioned in the earth in a positioning system, comprising;

(1) a drilled shallow borehole in the earth;

(2) a support casing comprising a piece of pipe closed at the bottom, of selected length and diameter, positioned in said borehole, surrounded by tamped sand in the annulus between said pipe and the earth;

(3) a plurality of angularly-spaced radial positioning screws through said pipe near its top end;

(4) said tilt meter attached to a tubular support means and positioned vertically inside said pipe; sand poured around said tubular support means at its bottom end;

the upper end of said tubular support means locked by said positioning screws to hold said support means vertical.

(5) a streamlined cover means over said borehole at the surface; and (6) the void space under said streamlined cover means filled with thermal insulation means.

14. In a system for underground combustion of a combustible material in a selected subsurface geological formation F at a selected depth D below the surface, said system including a first input well drilled to a depth D to said formation F and adapted to receive air at a selected pressure P for combustion of said combustible material, and at least one second output well drilled to depth D to said formation F, through which products of said combustion can be brought to the surface;

apparatus for monitoring the outward progress of the flame front from said first well, comprising;

(a) a plurality of tilt meters to be positioned at or near the surface of the earth, arranged in at least one array between said first well and said second well;

(b) means to supply air under pressure to said input well, and to ignite said combustible material in said formation F at said first well;

whereby a flame front will be started, which will travel outwardly as a function of the integrated flow of air supplied to said first well;

(c) means for recording the output signals from said tilt meters as a function of time; and (d) said tilt meters indicate the tilt in two orthogonal directions, and including means to position and tilt meters such that one of said orthogonal direction lies in the line to said first well.

15. In a system for underground combustion of a combustible material in a selected subsurface geological formation F at a selected depth D below the surface, said system including a first input well drilled to a depth D to said formation F at a selected depth D below the surface, said system including a first input well drilled to a depth D to said formation F and adapted to receive air at a selected pressure P for combustion of said combustible material, and at least one second output well drilled to depth D to said formation F, through which products of said combustion can be brought to the surface;

apparatus for monitoring the outward progress of the flame front from said first well, comprising;

(a) a plurality of tilt meters to be positioned at or near the surface of the earth, arranged in at least one array between said first well and said second well;

(b) means to supply air under pressure to said input well, and to ignite said combustible material in said formation F at said first well;

whereby a flame front will be started, which will travel outwardly as a function of the integrated flow of air supplied to said first well;

(c) means for recording the output signals from said tilt meters as a function of time; and (d) in which said plurality of tilt meters are divided into at least two groups, each group positioned in a radially spaced array, angularly spaced from each other.

* * * * *